United States Patent [19]

Kaufman

[11] Patent Number: 5,072,760

[45] Date of Patent: Dec. 17, 1991

[54] DEVICE FOR DRAWING A YARN INTO A WEFT ACCUMULATOR

[75] Inventor: Josef Kaufman, Elsau, Switzerland

[73] Assignee: Sulzer Brothers Limited, Winterthur, Switzerland

[21] Appl. No.: 566,424

[22] PCT Filed: Feb. 16, 1990

[86] PCT No.: PCT/CH90/00036

§ 371 Date: Aug. 30, 1990

§ 102(e) Date: Aug. 30, 1990

[87] PCT Pub. No.: WO90/11396

PCT Pub. Date: Oct. 4, 1990

[51] Int. Cl.[5] ..... D03D 47/34

[52] U.S. Cl. ..... 139/452; 226/97

[58] Field of Search ..... 242/47.01; 226/97; 139/452, 435.1

[56] References Cited

U.S. PATENT DOCUMENTS 3,834,600 9/1974 Benchemoul ..... 226/97

4,002,190 1/1977 Sevcik et al. ..... 139/452

FOREIGN PATENT DOCUMENTS 0307885 3/1989 European Pat. Off. .

3123760 2/1982 Fed. Rep. of Germany .

8712946 1/1988 Fed. Rep. of Germany .

*Primary Examiner*—Andrew M. Falik

*Attorney, Agent, or Firm*—Kenyon & Kenyon

[57] ABSTRACT

In a device for drawing a weft yarn (2) into a weft accumulator of a loom, weft yarn is wound during weaving by a winding tube (41') on to a stationary accumulator drum (400) and drawn off the same. To draw in the web yarn (2) the tube (41') is so rotated as to register with the inlet of a slotted tube (51). The same extends externally around the drum (400) as far as an eye (60) disposed on the draw-off side of the drum (400). An injector nozzle (43) on the entry side of the accumulator draws the weft yarn automatically through the winding tube (41') and the slotted tube (51) as far as the yarn eye (60).

7 Claims, 2 Drawing Sheets

DEVICE FOR DRAWING A YARN INTO A WEFT ACCUMULATOR

Figure 1:
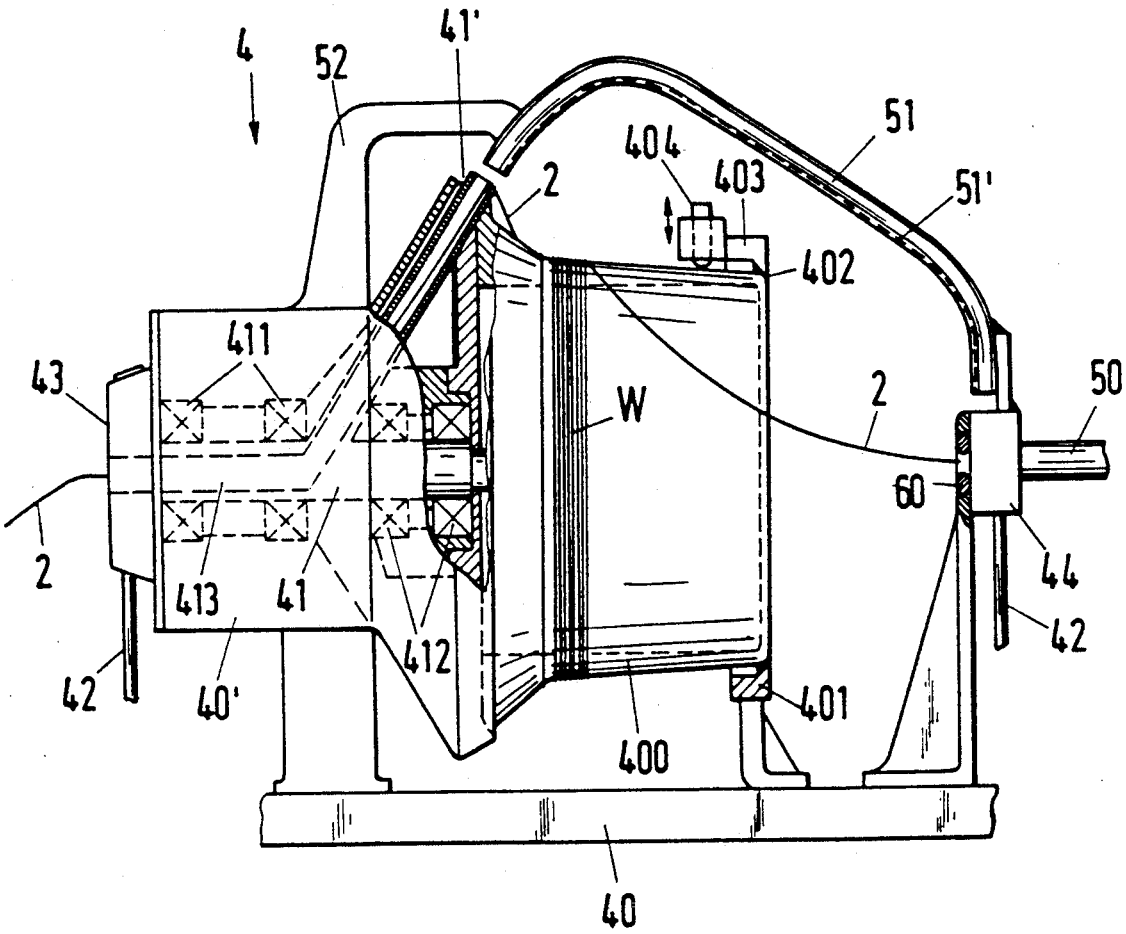

The invention relates to a device for drawing a yarn into the weft accumulator of a loom, weft yarn being stored in turns on a stationary drum of the accumulator.

German utility model specification No. G 87 12946.9 discloses an accumulator of this kind in which a number of blowing nozzles and yarn-guiding elements or, for example, troughs are provided to facilitate automatic threading of the weft yarn.

However, the techniques which have been used to automatically thread a weft yarn onto an accumulator have been rather cumbersome and complex.

Accordingly, it is an object of the invention to provide a relatively simple device for threading a weft yarn into an accumulator.

It is another object of the invention to simplify the technique required for threading a weft yarn onto a weft yarn accumulator for a loom.

Briefly, the invention is directed to a weft accumulator having a rotatable hollow shaft with a winding tube extending angularly therefrom for passage of a weft yarn therethrough, a storage drum for receiving and winding a weft yarn from the winding tube thereon and a yarn eye spaced coaxially from the drum in order to receive a weft yarn therefrom. In accordance with the invention, a bent tube extends over the storage drum from the winding tube to adjacent the yarn eye for conveying a weft yarn therebetween. In addition, the bent tube has a longitudinally extending slot facing the storage drum in order to permit a yarn to pass therethrough from within the tube onto the drum.

In addition, an injector is positioned at an upstream end of the hollow shaft in order to inject a weft yarn into the hollow shaft and, thus, through the winding tube into the bent tube. The injector includes an entry eye coaxial of an upstream end of the shaft and a chamber between the entry eye and the shaft for receiving and directing a flow of compressed air into the hollow shaft while creating a suction force in the entry eye for drawing a weft yarn positioned thereat into the entry eye and the hollow shaft. A compressed air line is also connected to the injector for supplying compressed air thereto. In addition, the injector has a valve between the compressed air line and the chamber in order to control the passage of compressed air into the chamber and, thus, into the hollow shaft.

A second injector is also positioned adjacent and downstream of the yarn eye for drawing a weft yarn through the yarn eye. This injector cooperates with a tube which extends therefrom coaxially of the yarn eye for receiving a weft yarn. In addition, a compressed air line is connected to the second injector for supplying compressed air thereto.

The bent tube for deflecting the weft yarn extends from the exit cross-section of the winding tube on the periphery of the accumulator drum to a yarn eye disposed in prolongation of the drum axis and is slotted on the side near the accumulator.

It is therefore possible, using just a single injector nozzle, to bring the weft yarn reliably as far as the yarn eye after the accumulator without further elements of the device having to be operative inside the accumulator.

Figure 2:
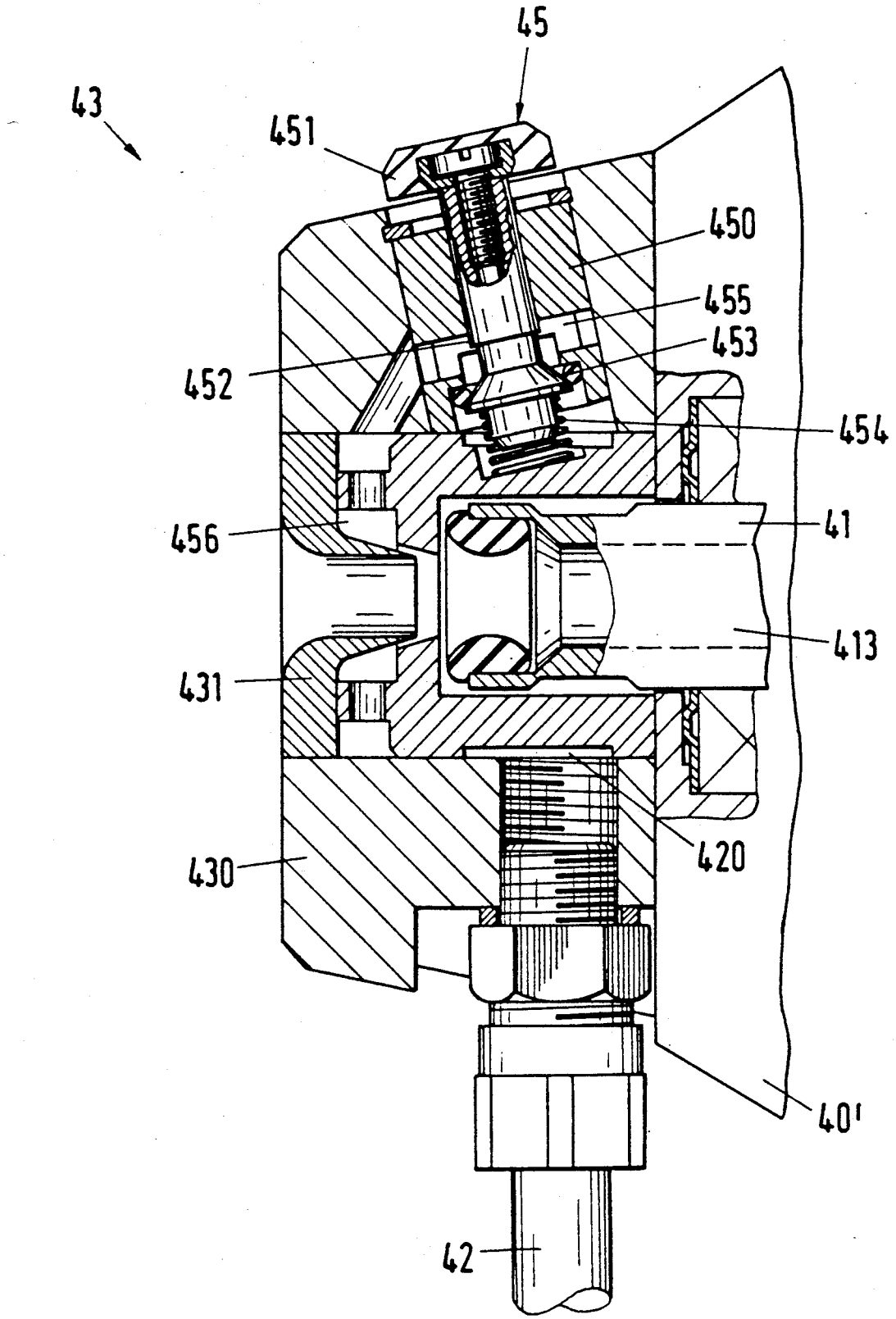

These and other objects and advantage of the invention will become more apparent from the following detailed description taken in conjunction with the accompanying drawings wherein:

FIG. 1 is a view in partial longitudinal section of a weft accumulator according to the invention, and FIG. 2 is a section through the injector at the entry to the weft accumulator.

A weft accumulator 4 of known kind, for example, the accumulator known from DE-OS 3 123 760, is used. Weft yarn 2 is introduced on the axis of weft accumulator 4 into a bore 413 in a shaft 41, then deflected into a winding tube 41' whence yarn 2 is deposited in a number of turns W on an accumulator drum 400. Shaft 41 is driven by a controlled electrical drive (not shown) inside a casing 40', the same being mounted on a frame 40. The drum 400 is stationary and is mounted on the shaft 41 by way of bearings 412 and in casing 40' by way of bearings 411. On the draw-off side (on the right in FIG. 1) of the drum 400 there is an annular brush holder 401 having an inwardly extending brush 402 for ensuring that the turns of weft yarn are drawn of the drum 400 in an orderly fashion. The brush holder 401 is formed with a slot 403 at the top in FIG. 1.

A yarn eye 60 and thereafter an injector 44 with a tube 50 are in known manner disposed on a spindle with the accumulator. The injector 44 is supplied with compressed air through a line 42. A bent guide tube 51 extends from the outlet of winding tube 41 as far as the injector 44 and is slotted on the inside 51' to permit the yarn to pass therethrough from within the bent tube 51 onto the drum 400. The tube 51 is secured to a holder 52 on the casing 40'.

As shown, an injector 43 is mounted on the casing 40' in order to provide for the threading in of a weft yarn to into bore 413 of the hollow shaft 41. The injector 43 is also connected with a compressed air supply line 42 to receive compressed air therefrom.

Referring to FIG. 2, the injector 43 has a housing 430 mounted on the casing 40' which houses an entry eye 431 coaxially of the bore 413 in the shaft 41 and an insert which is disposed about the shaft 431 and a downstream end of the entry eye 41 to define a chamber 456 about the downstream end of the entry eye 431. As illustrated, the insert and the downstream end of the entry eye 431 define a narrowed annular passage. The insert also has an annular recess which defines a chamber 420 for receiving compressed air from the compressed air line 42.

The housing 430 contains a valve 45 between the compressed air line 42 and the chamber 456 for controlling the passage of compressed air into the chamber 456. To this end, the valve 45 has a body 450 secured within a bore of the housing 430, for example by means of a split ring. This body 450 defines a chamber 455 which communicates through suitable ports and bores with the chamber 456 about the entry eye 431. In addition, a tappet 452 is slidably mounted within the body 450 and has a conical portion which seats against a ring seal 453 in order to close off the chamber 455 from communication with the annular chamber 420. A spring 454 is also provided to bias the tappet 452 against the ring seal 453 as illustrated.

The valve 45 is also provided with a control 451 at the upper end as illustrated.

During operation, compressed air passes through the line 42 into the annular chamber 420 and, therefrom, to the bottom part of the valve 45 near the spring 454. The chamber 420 is therefore separated from the top chamber 455 in the valve 45. When as shown in FIG. 2 the valve 45 has been opened by depression of the control 451, compressed air can pass from line 42 into the annular chamber 456 which extends around entry eye 431 of the weft accumulator. Air therefore flows through in bore 413 of shaft 41 so that a weft yarn retained before eye 431 is drawn into the accumulator. Thus, a suction force is created in the entry eye 431 for drawing the weft yarn positioned thereat into the entry eye 431 and the hollow shaft 41.

During the drawing-in step, the winding tube 41′ is automatically moved by an appropriate control of the drive of the shaft 41 into a position in which the tube 41′ is in registration with the inlet of the bent guide tube 51. The compressed air leaving the injector 42 then goes with the weft yarn 2 through the winding tube 41′ and guide tube 51 to the injector 44. If the same is also energized with compressed air, the yarn is conveyed onwards through the eye 60 and injector 44 into the tubular member 50. After the yarn 2 has been fully drawn into the accumulator 4 and the subsequent tube 50, winding can be initiated by pressing a stop finger 404 on to the drum periphery, the winding tube 41′ starting to rotate with the shaft 41.

I claim:

1. A weft accumulator comprising a rotatable hollow shaft having a winding tube extending angularly therefrom for passage of a weft yarn therethrough;

a storage drum for receiving and winding a weft yarn from said tube thereon;

a yarn eye spaced coaxially from said drum to receive a waft yarn therefrom;

a bent tube extending over said storage drum from said winding tube to adjacent said yarn eye for conveying a weft yarn therebetween, said bent tube having a longitudinally extending slot facing said storage drum to permit a yarn to pass therethrough from within said bent tube onto said drum.

2. A weft accumulator as set forth in claim 1 which further comprises an injector having an entry eye coaxial of an upstream end of said shaft and a chamber between said entry eye and said shaft for receiving and directing a flow of compressed air into said hollow shaft while creating a suction force in said entry eye for drawing a weft yarn positioned thereat into said entry eye and said hollow shaft.

3. A weft accumulator as set forth in claim 2 which further comprises a compressed air line connected to said injector for supplying compressed air thereto and wherein said injector has a valve between said line and said chamber for controlling the passage of compressed air into said chamber.

4. A weft accumulator as set forth in claim 2 which further comprises a second injector adjacent and downstream of said yarn eye for drawing a weft yarn through said yarn eye.

5. A weft accumulator as set forth in claim 4 which further comprises a tube extending from said second injector coaxially of said yarn eye for receiving a weft yarn and a compressed air line connected to said second injector for supplying compressed air thereto.

6. A weft accumulator as set forth in claim 1 wherein said bent tube has a outlet end downstream of said yarn eye relative to a direction of weft yarn movement and transverse to an axis of said yarn eye.

7. A weft accumulator as set forth in claim 1 wherein said winding tube has an outlet end for registration with an inlet end of said bent tube for conveying a weft yarn therebetween.

* * * * *

UNITED STATES PATENT AND TRADEMARK OFFICE

CERTIFICATE OF CORRECTION

PATENT NO. : 5,072,760

DATED : December 17, 1991

INVENTOR(S) : Josef Kaufman

It is certified that error appears in the above-identified patent and that said Letters Patent is hereby corrected as shown below:

Column 2, line 20, change "of" to --off-- line 24, change "a spindle" to --an axis spindle--

Signed and Sealed this

Nineteenth Day of October, 1993

*Attest:*

*Attesting Officer*

BRUCE LEHMAN

*Commissioner of Patents and Trademarks*